US006928945B1

(12) United States Patent
Tebo, Jr.

(10) Patent No.: US 6,928,945 B1
(45) Date of Patent: Aug. 16, 2005

(54) BOAT DOCKING AID

(76) Inventor: Donald W. Tebo, Jr., 5104 Circle Pl., Baltimore, MD (US) 21227

( * ) Notice: Subject to any disclaimer, the term of this patent is extended or adjusted under 35 U.S.C. 154(b) by 17 days.

(21) Appl. No.: 10/847,569

(22) Filed: May 18, 2004

(51) Int. Cl.[7] ..... B63B 21/00
(52) U.S. Cl. ..... 114/230.15
(58) Field of Search ..... 114/218, 221 R, 114/230.15; 119/802, 803; 43/87

(56) References Cited

U.S. PATENT DOCUMENTS 3,758,922 A * 9/1973 Field ..... 24/136 R
3,765,061 A 10/1973 Nash
3,861,346 A 1/1975 Pina
3,878,808 A 4/1975 Mock, Jr.
3,993,013 A 11/1976 Nunziato et al.
4,004,539 A 1/1977 Wesson
4,414,712 A 11/1983 Beggins
4,519,643 A * 5/1985 Harris ..... 294/19.1
4,532,833 A 8/1985 Downs
4,599,074 A * 7/1986 Beckly ..... 441/80
4,667,617 A 5/1987 Molitor
5,003,907 A 4/1991 Roach et al.
5,398,634 A 3/1995 Eagan
5,423,108 A * 6/1995 Brennan ..... 24/134 R
5,538,302 A 7/1996 Travis
5,586,514 A 12/1996 Yuscavage
5,620,221 A 4/1997 Wilke
5,625,922 A 5/1997 Morad
5,634,421 A 6/1997 Velarde
5,799,602 A 9/1998 Trillo
5,931,112 A * 8/1999 Lacan ..... 114/218
5,979,106 A 11/1999 Butler
6,273,017 B1 8/2001 Griffin
6,418,592 B1 7/2002 Mohtasham

* cited by examiner

*Primary Examiner*—Ed Swinehart
(74) *Attorney, Agent, or Firm*—Rosenberg, Klein & Lee

(57) ABSTRACT

A boat docking aid in the form of a mooring apparatus (100) includes a handle assembly (110), a flexible member (120) coupled to the handle assembly and a clamp assembly (130) coupled to the handle assembly. The handle assembly includes a longitudinally displaceable slider (114) mounted on the handle member. The slider is freely displaceable toward one end (1126) of the handle member and releasably engaged with the handle member against displacement toward the opposing end (1128). The flexible member forms a loop (124) with opposing ends (122) disposed in overlapping relationship and coupled to the slider for displacement therewith. The loop changes in size in correspondence with the displacement of the slider. The clamp assembly includes a passage (134, 134') through which a mooring line (30) is passed, the mooring line being freely displaceable in one direction, but releasably locked against displacement in an opposing direction.

28 Claims, 9 Drawing Sheets

BOAT DOCKING AID

BACKGROUND OF THE INVENTION

1. Field of the Invention

This invention directs itself to a device for securing a watercraft to a structure, such as a dock, pier or piling for mooring the watercraft thereto. In particular, this invention directs itself to an apparatus that includes a flexible member disposed at the distal end of a handle member which is used to encircle a mooring post or cleat, and tightened thereon. Still further, this invention directs itself to a mooring apparatus having an elongated handle member to which a slider is displaceably mounted, the slider being coupled to a flexible member formed in a loop, the diameter of the loop being varied in correspondence with displacement of the slider. Additionally, the apparatus includes a clamp for releasable engagement of a mooring line.

2. Prior Art

The difficulty in easily bringing a small watercraft, both sail and power, to stop adjacent a structure such as a dock, pier, piling or an anchored boat and then mooring or otherwise securing the watercraft thereto has long been known. The potential hazards to personnel assisting from either the dock or the boat are also well known. Many prior inventions have been attempted to overcome the recognized problems and hazards associated with docking small boats. The best prior art known to the Applicant include U.S. Pat. Nos. 5,625,922; 4,414,712; 4,667,617; 5,979,106; 3,765,061; 5,634,421; 5,398,634; 5,003,907; 5,586,514; 5,538,302; 5,620,221; 5,799,602; 6,418,592; 3,993,013; 4,004,539; 4,532,833; 6,273,017; 4,519,643; 3,861,346; and, 3,878,808.

In some prior art systems, such as those disclosed in U.S. Pat. Nos. 6,273,017; 4,519,643; and, 3,878,808 a rope handling device is provided for assisting in the mooring of a boat. In such systems, a loop of rope is tightened on a piling by pulling on the opposite end of the rope and then fastening it to a cleat on a boat. Thus, if the waters are rough during the procedure, the end of the rope may be pulled from the user's hand before the user is able to tie it to a cleat.

The invention of the subject Patent Application overcomes the problems of the prior art by providing a loop which may be tightened onto a piling, cleat, or other structure that is releasably locked against displacement that would otherwise loosen the loop. Further, the instant invention provides a clamp for securing a mooring line thereto. Thus, the loop and mooring line are independent and each is releasably lockingly engaged against loosening.

SUMMARY OF THE INVENTION

An apparatus for mooring a boat includes a longitudinally extended handle member having an opening adjacent a distal end thereof. The apparatus includes a slider longitudinally displaceably mounted on the handle member. The slider is freely displaceable toward a proximal end of the handle member and releasably engaged with a handle member against displacement toward the distal end. The apparatus includes a flexible member having opposing ends disposed in overlapping relationship to form a loop. The overlapped opposing ends are passed through the opening of the handle member and are coupled to the slider for displacement therewith. The loop is reduced in size in correspondence with the slider being displaced toward the proximal ends.

The apparatus includes a clamp coupled to the slider. The clamp has at least one first engaging member for releasably engaging a mooring line.

From another aspect, the apparatus for mooring a boat includes a handle assembly having a first member and a displaceable second member coupled to the first member. The second member is freely displaceable toward a first end of the first member and releasably engaged with the first member against displacement toward an opposing second end of the first member. The apparatus includes a flexible member having opposing ends disposed in overlapping relationship to form a loop. The overlapped opposing ends are coupled to the second member for displacement therewith. The loop is changed in size responsive to the second member being displaced relative to the first member. The apparatus also includes a clamp coupled to the handle assembly. The clamp has at least one first engaging member for releasably engaging a mooring line.

DESCRIPTION OF THE PREFERRED EMBODIMENTS

Figure 1:
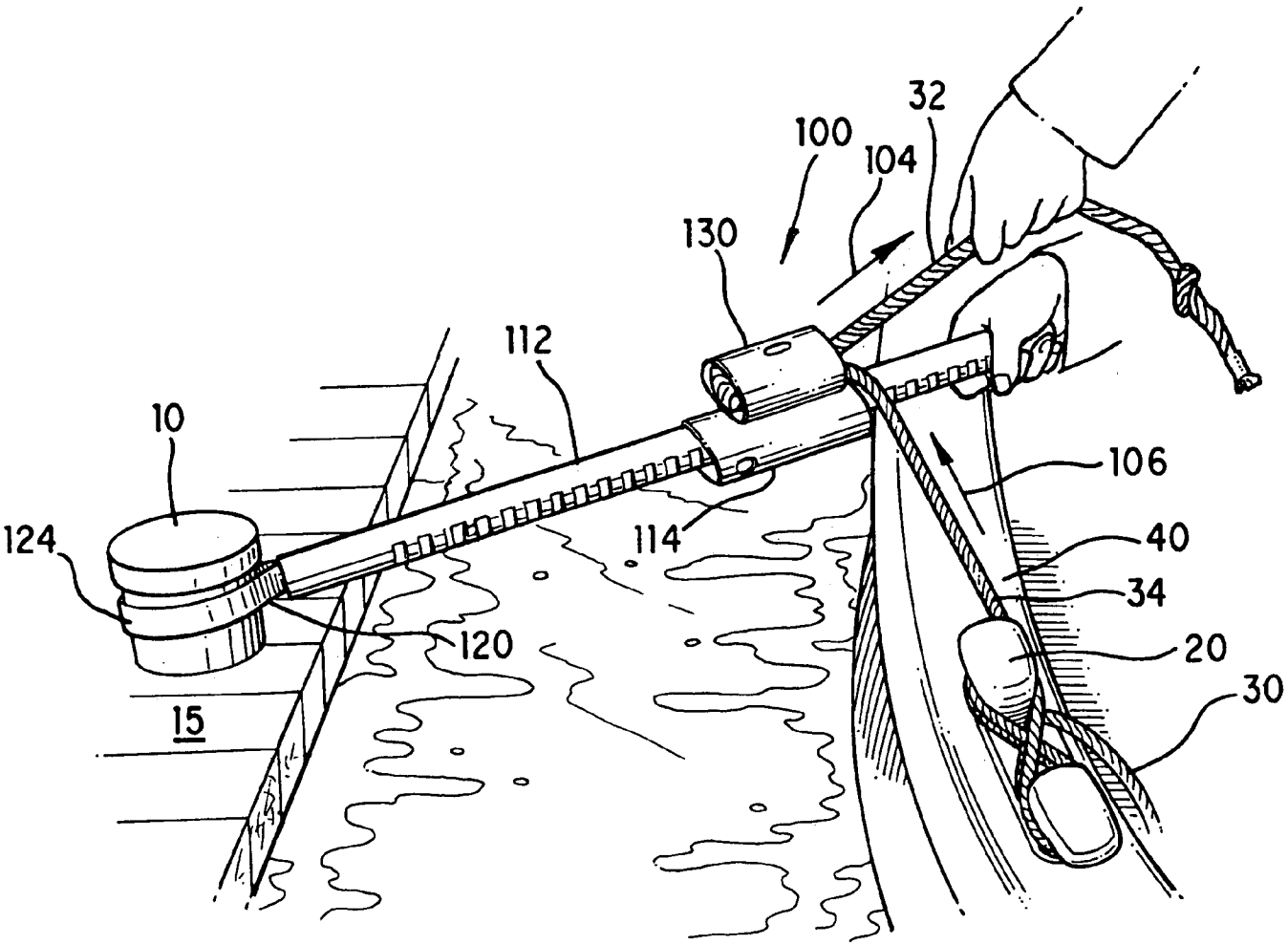
FIG. 1 is a perspective view illustrating use of the present invention.
Figure 2:
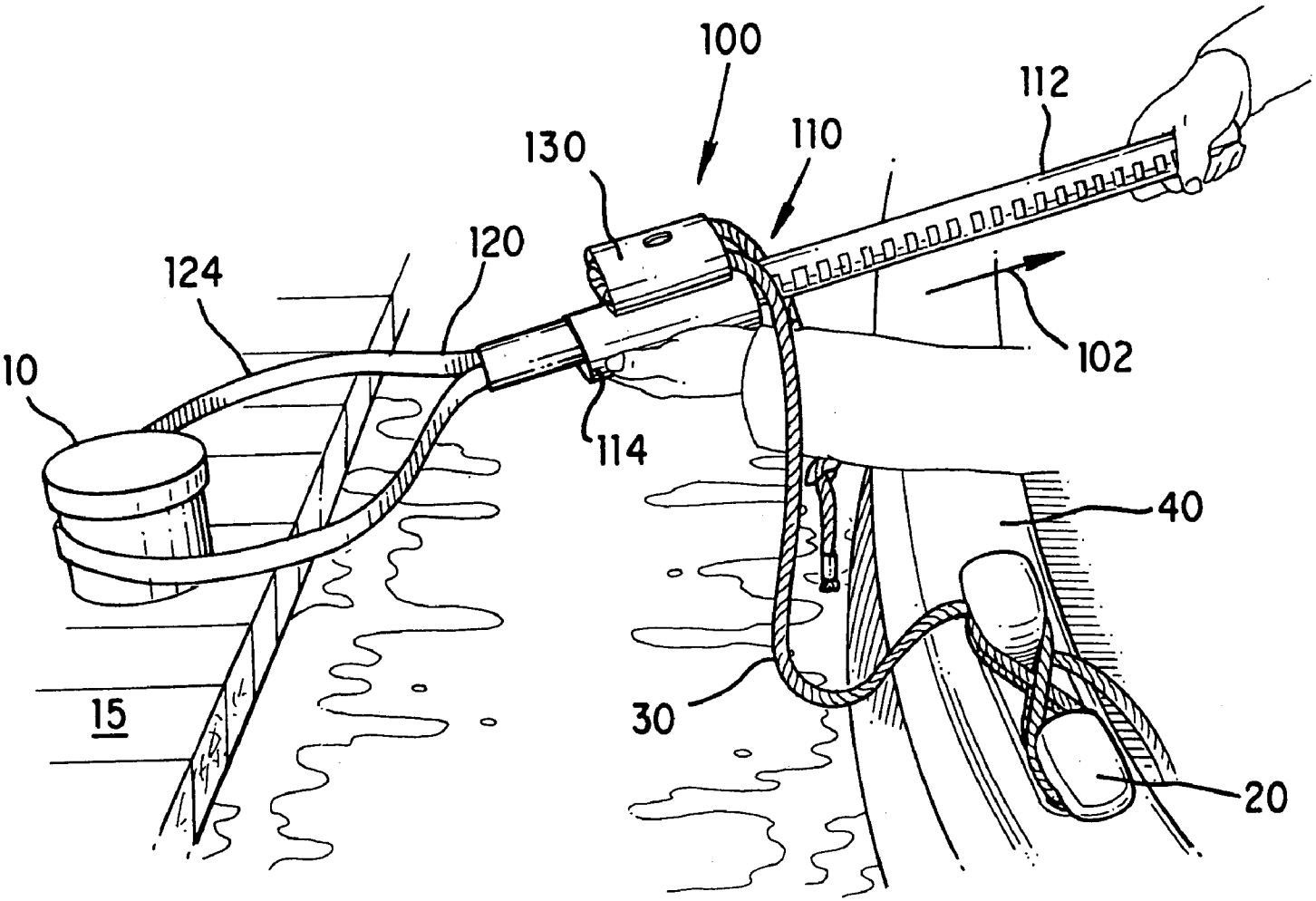
FIG. 2 is a perspective view further illustrating use of the present invention.

Referring to FIGS. 1 and 2, there is shown mooring apparatus 100 for use in mooring a small water craft 40 to a dock 15. The apparatus 100 allows a user to engage a bollard 10 or a cleat (not shown) of the dock 15 with a flexible member 120. The apparatus 100 is further provided with a clamp 130 which allows the user to tighten a mooring line 30 extending to the apparatus 100 from a cleat 20 of the boat 40.

The mooring apparatus 100 includes a handle assembly 110, a flexible member 120 coupled to the handle assembly 110, and a mooring line clamping assembly 130 coupled to the handle assembly 110. Handle assembly 110 includes a longitudinally extended handle member 112 and a slider 114 displaceably mounted on the member 112 to be freely displaceable toward a proximal end of the handle member 112 and releasably engaged with the handle member 112 against displacement toward the distal end. The flexible member 120 is formed in a loop 124 and coupled to the slider 114 for displacement therewith, the loop 124 being varied in size as a function of the displacement of the slider 114. Thus, when the boat 40 is being moored to the dock 15, the user engages the bollard 10 with the loop 124 and then displaces the slider 114 in the direction indicated by directional arrow 102. By that action, the loop 124 tightens around the bollard 10, as shown in FIG. 2. The user then pulls on the end portion 32 of mooring line 30 in the direction indicated by directional arrow 104. That action pulls the slack out of the intermediate portion 34 of mooring line 30 in a direction indicated by directional arrow 106 to thereby provide a tight and flexible coupling between the boat 40 and the bollard 10 of dock 15.

Figure 3:
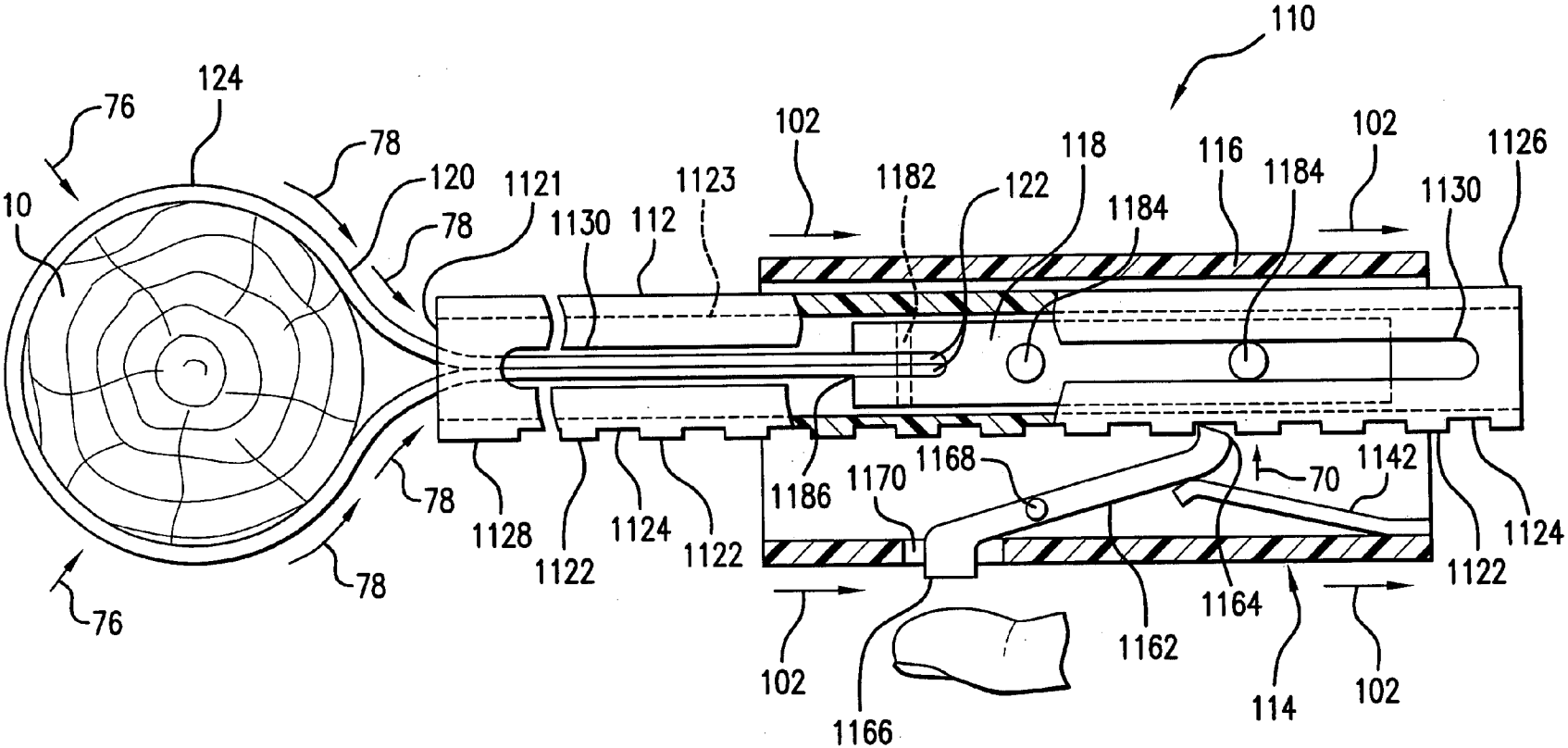
FIG. 3 is a plane view showing the handle assembly of the present invention, partially cut away.

The details of handle assembly 110 are shown in FIG. 3. The handle member 112 extends longitudinally between opposing proximal and distal ends 1126 and 1128. Although the handle member 112 is depicted as a tubular member, it is within the scope of the present invention to include a solid handle member with the coupling to the flexible member 120 being made to the slider external to the handle member, with the overlapped end portion of the flexible member 120 passing through an opening in a structure that is coupled to the distal end 1128 of handle member 112. Such a structure may take the form of a plate-like member having an aperture for passage of flexible member 120 or a pair of spaced column-like members with the flexible member 120 passing therebetween, as examples.

Handle member 112 includes a plurality of teeth 1122 formed on at least one side thereof, respective pairs of teeth being separated one from another by a respective recess 1124. Handle member 112 further includes a longitudinally extended slotted opening 1130 formed through a wall of the handle member 112 and in open communication with a longitudinally extended bore 1123 formed in handle member 112. The slider 114 includes a slider body 116 that is sleeved over the handle member 112. The slider body 116 is coupled to an anchor member 118 disposed within the bore 1123 by the pin-like members 1184. Other fasteners or structures may be used to secure the slider body 116 to the anchor member 118, without departing from the inventive concepts described herein. By virtue of the slider body's coupling to the anchor member 118 disposed within the bore 1123, the slider body 116 need not completely encompass the handle member 112. However, forming the slider body to completely encompass the handle member 112 provides a much more secure displaceable coupling of the slider 114 to the handle member 112.

The end portions 122 of flexible member 120 are disposed in overlapping relationship within a recess 1186 formed in the anchor member 118 and secured therein by a pin or fastener 1182. The overlapped end portions 122 of flexible member 120 pass through the opening 1121 disposed at the distal end 1128 of handle member 112, passing into the bore 1123 for coupling to the anchor member 118. Thus, when the slider 116 is displaced toward the proximal end 1126 of handle member 112, as indicated by directional arrow 102, the overlapped portion of the flexible member 120 is drawn into the bore 1123 through the opening 1121, as indicated by directional arrow 78. As the flexible member 120 is drawn into the bore 1123 of handle member 112, the diameter of the loop 124 is reduced, as indicated by directional arrow 76, to thereby tighten the loop 124 around the bollard 10. As previously noted, the loop 124 may be just as easily tightened around a cleat, or other structure, as the flexible member 120 is able to conform to the shape of the object being encompassed thereby.

Slider 114 is able to freely be displaced in the direction indicated by the directional arrow 102, toward the proximal end 1126 of handle member 112. However, the slider 114 is releasably locked against displacement in an opposing direction, toward the distal end 1128 of handle member 112, such that once the bollard 10 is tightly engaged by the loop 124 of flexible member 120, such remains tightly engaged until manually released. The unidirectional releasable engagement of slider 114 is provided by an engaging member 1162 that is pivotably coupled to the slider body 116 by a pivotable coupling 1168. The distal end of engaging member 1162 is disposed within a respective recess 1124 between a pair of adjacent teeth 1122. The distal end of engaging member 1162 is provided with a camming surface 1164 so that the engaging member 1162 is pivotably displaced to pass over a proximally disposed tooth and thereby pass from one respective recess 1124 to another, as the slider 114 is displaced in the direction indicated by the arrow 102. The distal end of the engaging member 1162 is biased into a respective recess 1124, as indicated by directional arrow 70, by the elastic member 1142 that extends from the slider body 116.

Figure 4:
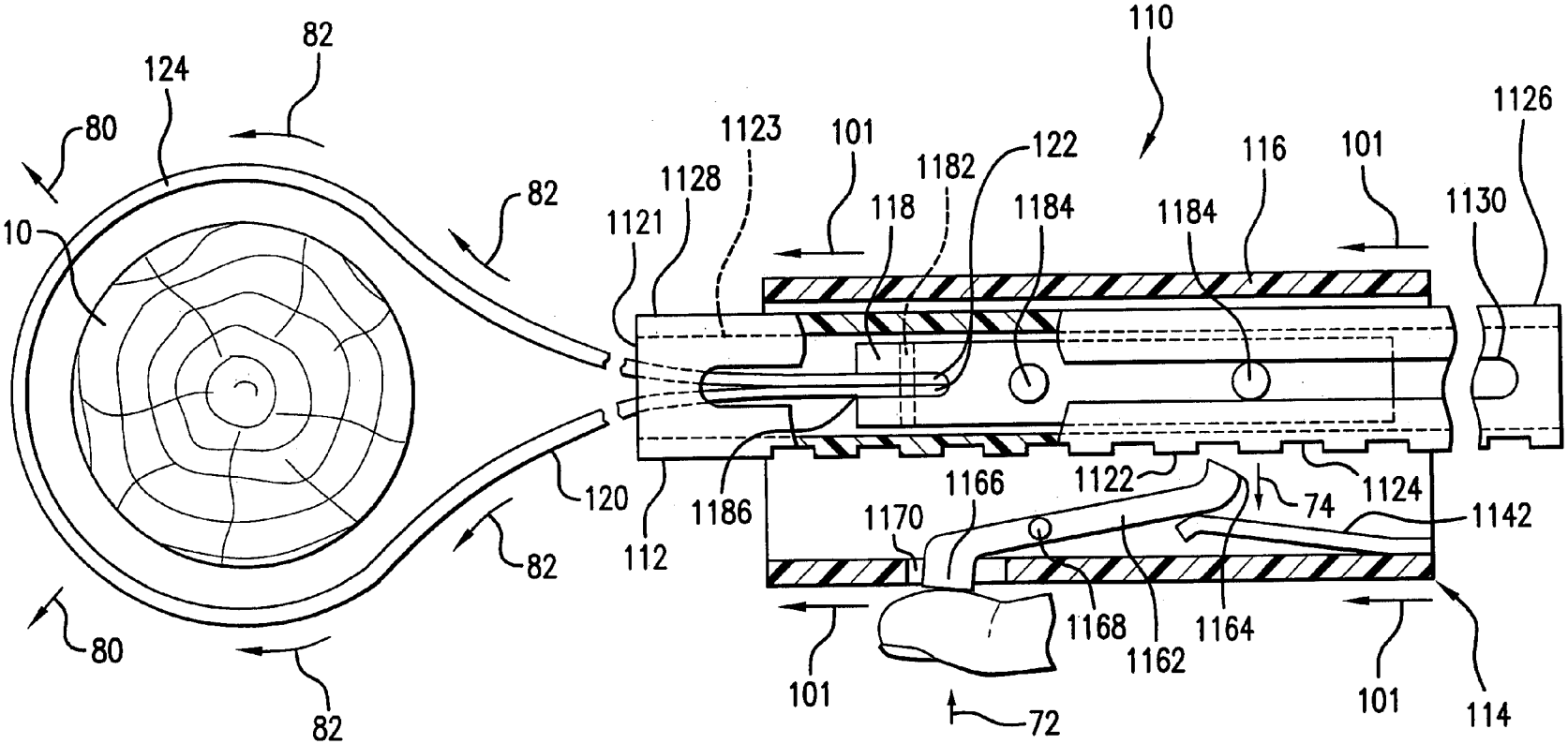
FIG. 4 is a plane view of the present invention, partially cut away, showing release of the slider from engagement with the handle member.

With reference to FIG. 4, when it is desired to disengage the mooring apparatus 100 from the bollard 10, the slider 114 is disengaged from the handle member 112 and displaced toward the distal end 1128 of handle member 112, as indicated by directional arrows 101. When the slider 114 is displaced toward the distal end 1128 of handle member 112, the overlapped portions of flexible member 120 are displaced from the opening 1121 of the bore 1123, as indicated by the directional arrows 82, to thereby enlarge the diameter of the loop 124, as indicated by the directional arrows 80, so that the loop 124 can be disengaged from the bollard 10. In order to disengage the slider 114 from its coupling with the handle member 112, a user depresses the displaceable portion 1166 of engaging member 1162 that extends through the opening 1170 of slider body 116, as indicated by directional arrow 72. That action causes the engaging member 1162 to pivot about the pivotal coupling 1168 to thereby displace the camming surface 1164 from a corresponding recess 1124 against the bias of the elastic member 1142, as indicated by directional arrow 74. With engaging member 1162 disengaged from handle member 112, the slider 114 is then freely displaceable toward the distal end 1128. By virtue of the coupling between the slider body 116 and the anchor member 118, the anchor member 118 is likewise displaced toward the opening 1121 of the bore 1123, and with it the overlapped portions of the flexible member 120.

Figure 5:
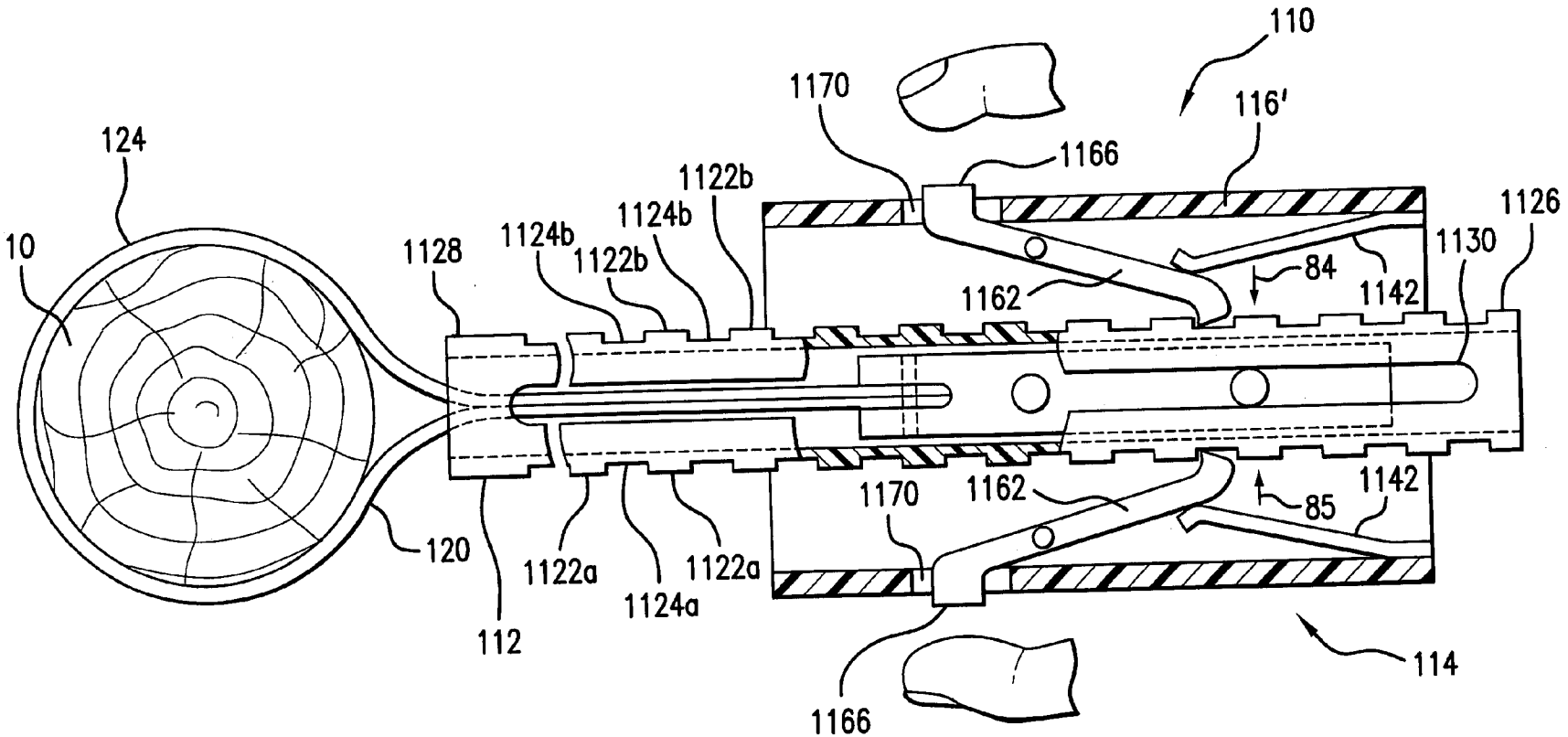
FIG. 5 is a plane view, partially cut away, showing an alternate configuration of the slider portion of the present invention.

Turning now to FIG. 5, there is shown an alternate configuration for slider 114. In this configuration, the slider body 116' includes a pair of engaging members 1162 respectively pivotally coupled thereto. Each engaging member 1162 in this dual engaging member configuration has a structure and functions like the single engaging member 1162 previously described. Each engaging member 1162 is likewise biased, as indicated by the directional arrows 84 and 85, into respective engagement with teeth 1122*a*, 1122*b* and disposed in a respective recess 1124*a*, 1124*b* that are disposed between pairs of corresponding teeth 1122*a*, 1122*b* formed on opposing sides of the handle member 112. The slider body 116' is thus freely slideable toward the proximal end 1126 of handle member 112 and is disengageable from the handle member 112 for movement toward the distal end 1128 by the concurrent depression of the displaceable portions 1166 of the two engaging members 1162 that extend through the corresponding openings 1170 in the slider body 116'. The use of multiple engaging members 1162 provides a greater strength coupling between the slider 114 and the handle member 112, as might be required for a water craft of larger size. Although an arrangement where the engaging members 1162 and corresponding teeth 1122*a* and 1122*b* are disposed 180° apart is believed to be the most ergonomic arrangement, the engaging members and corresponding teeth may be disposed in other orientations, if desired.

Figure 6:
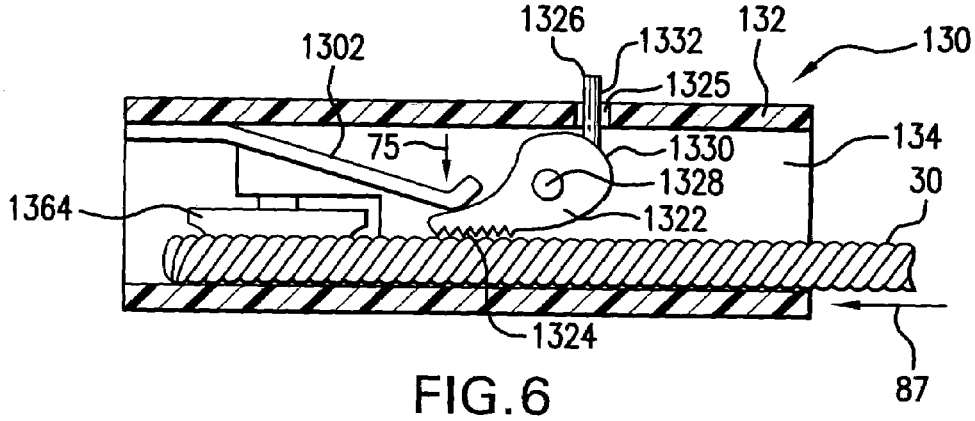
FIG. 6 is a cross-sectional elevation view of the clamp of the invention of the subject Patent Application.
Figure 7:
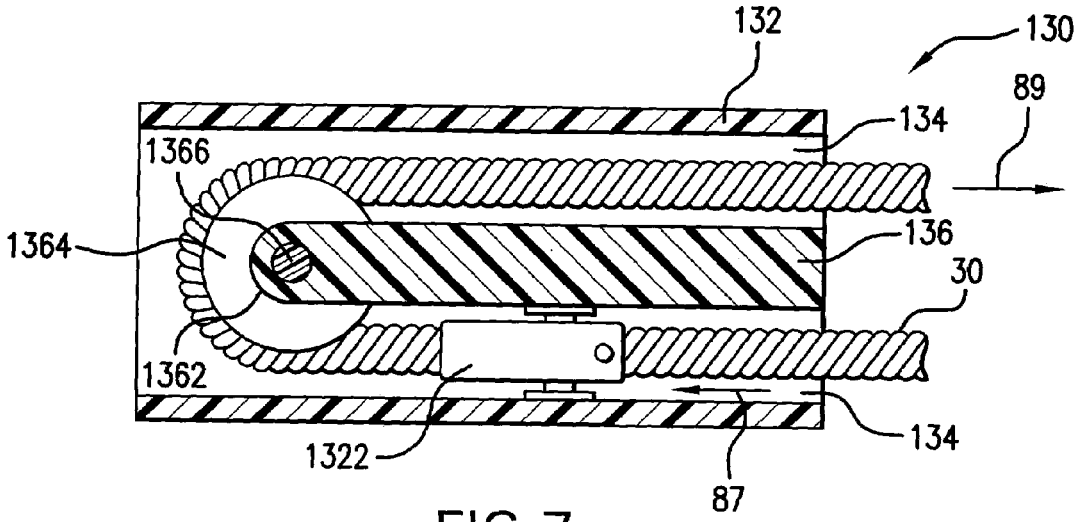
FIG. 7 is a transverse cross-sectional view of the clamp of the present invention.

Turning now to FIGS. 6 and 7, such details the structure of the clamp assembly 130. While the clamp assembly 130 has been depicted as being coupled to the slider 114, which is believed to be the most convenient arrangement for use, the clamp assembly 130 may be coupled directly to the handle member 112 without departing from the inventive concepts as herein developed. Clamp assembly 130 includes a clamp body 132 having a passage 134 formed therein through which the mooring line 30 passes. Passage 134 has a U-shaped contour with entrance and exit openings disposed at one side of clamp body 132. Substantially centrally disposed within the passage 134 is a roller 1364 over which the mooring line 30 is passed in order to reduce resistance of the mooring line to displacement within passage 134. Roller 1364 is pivotably coupled to an intermediate wall 136 of the clamp body 132 by an axle 1366.

Disposed in one leg of passage 134 is an engaging member 1322 that is pivotably coupled to the clamp body 132 by a pivot coupling 1328. Pivot coupling 1328 may be a pin or other fastener about which the engaging member 1322 is free to pivot. Engaging member 1322 extends into the passage 134 and includes a distally disposed camming surface 1324, allowing the mooring line 30 to be displaced freely in one direction, indicated by directional arrow 87, while being tightly engaged by the surface 1324 when displacement is attempted in an opposing direction. The surface 1324 is roughened or has a toothed contour and is biased into engagement with mooring line 30, as indicated by directional arrow 75, by the elastic member 1302 which extends from a wall of the clamp body 132 to the engaging member 1322. Thus, when a user pulls on the mooring line in a direction indicated by directional arrow 89, the mooring line passes freely through the passage 134, thereby allowing the user to pull out any slack in the mooring line.

The engaging member 1322 is provided with a displaceable portion 1326 which extends through an opening 1325 formed through a corresponding wall of the clamp body 132. The displaceable portion 1326 may be an integral part of the engaging member 1322, as will be shown in an alternate configuration, or, as shown in FIG. 6, the displaceable portion may be formed by a link member 1332 that extends through the opening 1325 to contact an end surface portion 1330 of the engaging member 1322. Thus, when the displaceable portion 1326 is depressed by a user, the camming surface 1324 is pivoted away from contact with the mooring line 30, against the bias force of elastic member 1302 to then permit the mooring line 30 to be freely displaced in any direction, but in particular, to allow the mooring line to move in a direction opposite to that indicated by the directional arrow 87.

Figure 8:
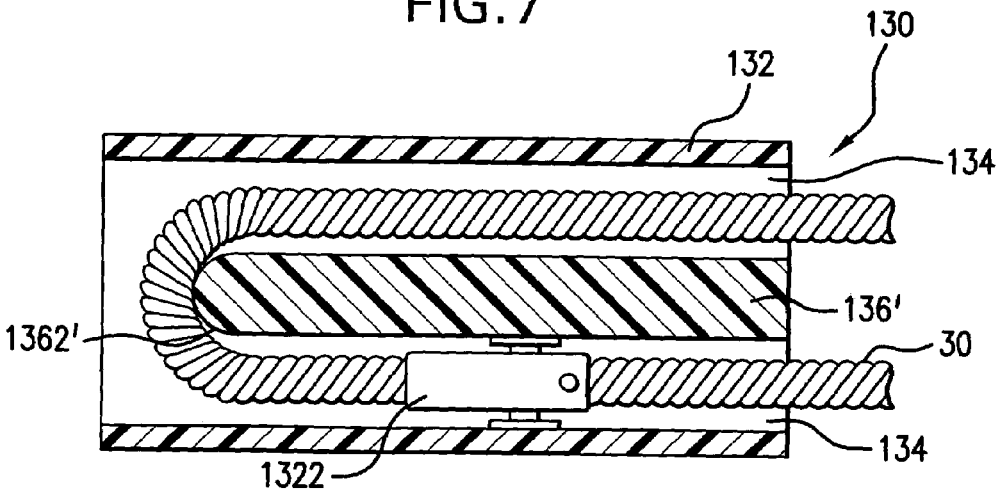
FIG. 8 is a transverse cross-sectional view of an alternate configuration of the clamp of the present invention.

Referring now to FIG. 8, there is shown an alternate configuration of the clamp assembly 130, wherein the intermediate wall 136' of the clamp body 132 is provided with a smoothly radius distal end 1362', the radius thereof being sufficient to allow the mooring line to easily pass thereover. In this configuration, no roller is required for the mooring line 30 to easily pass through the U-shaped passage 134.

Figure 9:
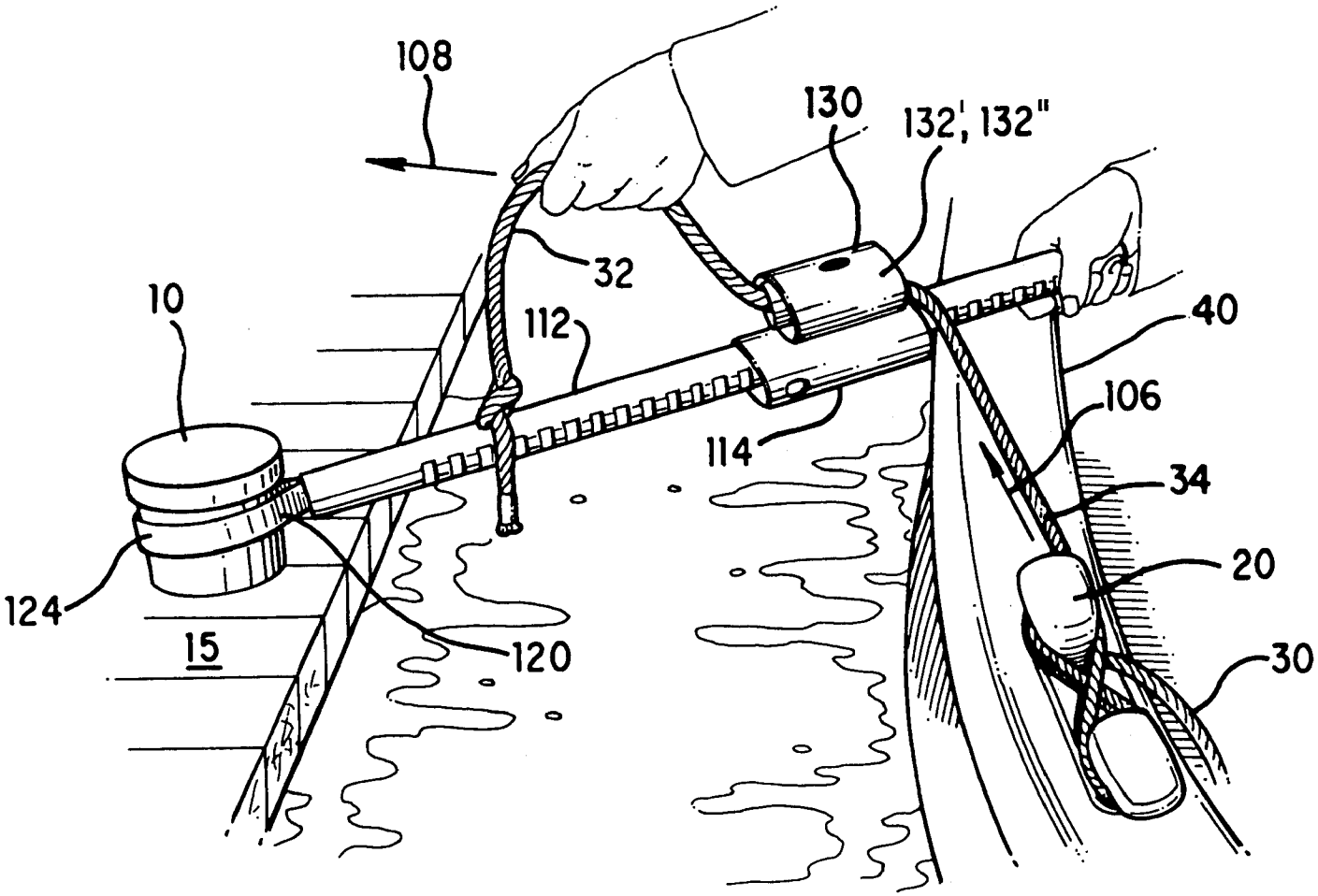
FIG. 9 is a perspective view showing use of a further alternate configuration of the clamp portion of the present invention.

Having the mooring line 30 pass into and out of the clamp assembly 130 on the same side of the clamp body is considered the most convenient arrangement for use. An L-shaped passage or linear passage may also be used. For example, clamp assembly 130 may be provided with a clamp body 132', 132", as shown in FIG. 9, wherein the mooring line 30 passes into the clamp 130 on one end thereof and exits from an opposing end. Thus, once the bollard 10 is tightly engaged by the loop 124 of flexible member 120, the user may then pull on the end portion 32 of mooring ling 30, in a direction indicated by directional arrow 108, to thereby displace the intermediate portion 34 of mooring line 30, in a direction indicated by directional arrow 106, to remove any slack therefrom.

Figure 10:
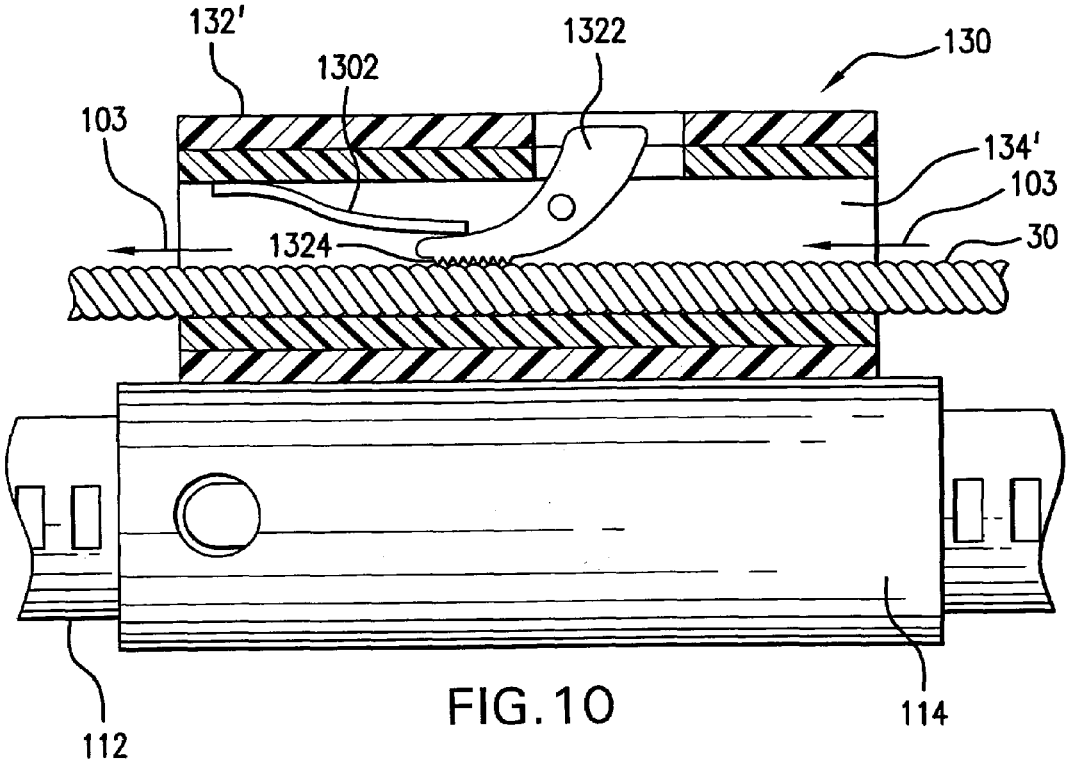
FIGS. 10 and 11 show an elevation cross-sectional view of the further alternate configuration of the clamp of the present invention; and, FIGS. 12 and 13 show a partially cut away view of yet a further alternate configuration of the clamp of the present invention.
Figure 11:
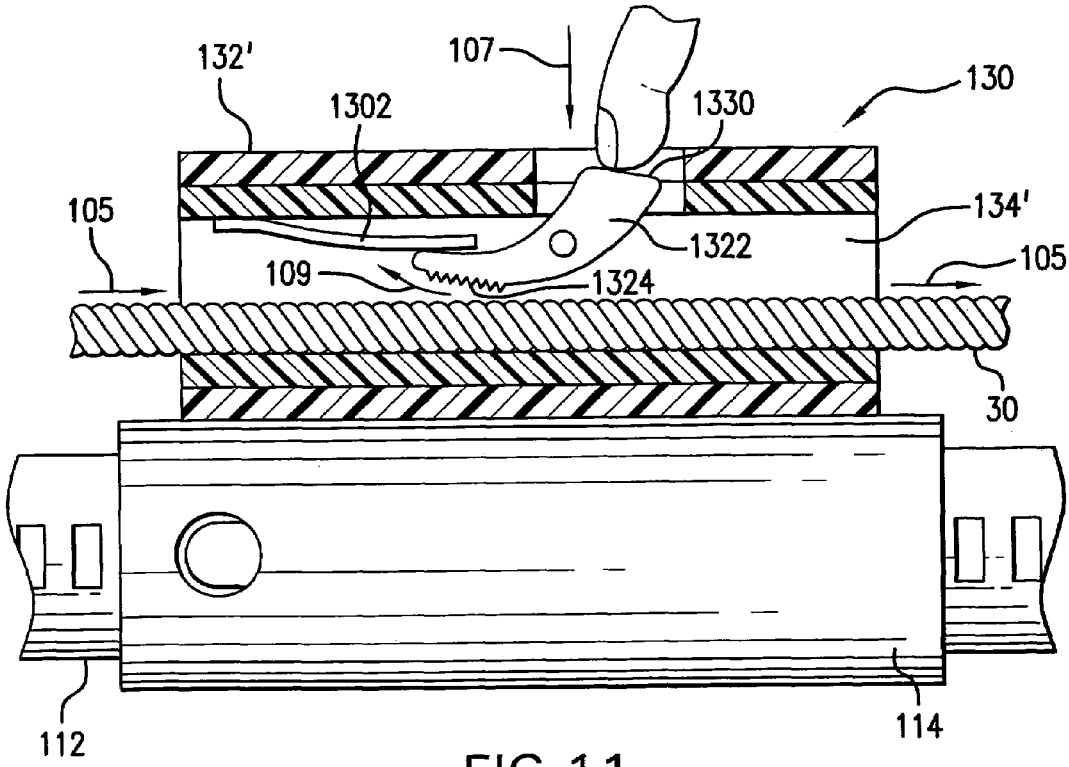

As shown in FIG. 10, clamp body 132' includes a passage 134' that extends from one longitudinal end thereof to an opposing longitudinal end. Extending into passage 134', is an engaging member 1322 that is biased by an elastic member 1302, as previously described. By that arrangement, the mooring line 30 is freely displaceable in a direction indicated by directional arrow 103, but is clampingly engaged by the member 1322 against displacement in an opposing direction. When it is desired to disengage the mooring line from clamp 130, the end surface portion 1330 of engaging member 1322 is depressed by a user, in the direction indicated by the directional arrow 107, to thereby rotate the member 1322, as indicated by directional arrow 109. The rotation of engaging member 1322 disengages the camming surface 1324 from engagement with the mooring line, allowing the mooring line to be displaced in the direction indicated by directional arrow 105.

Figure 12:
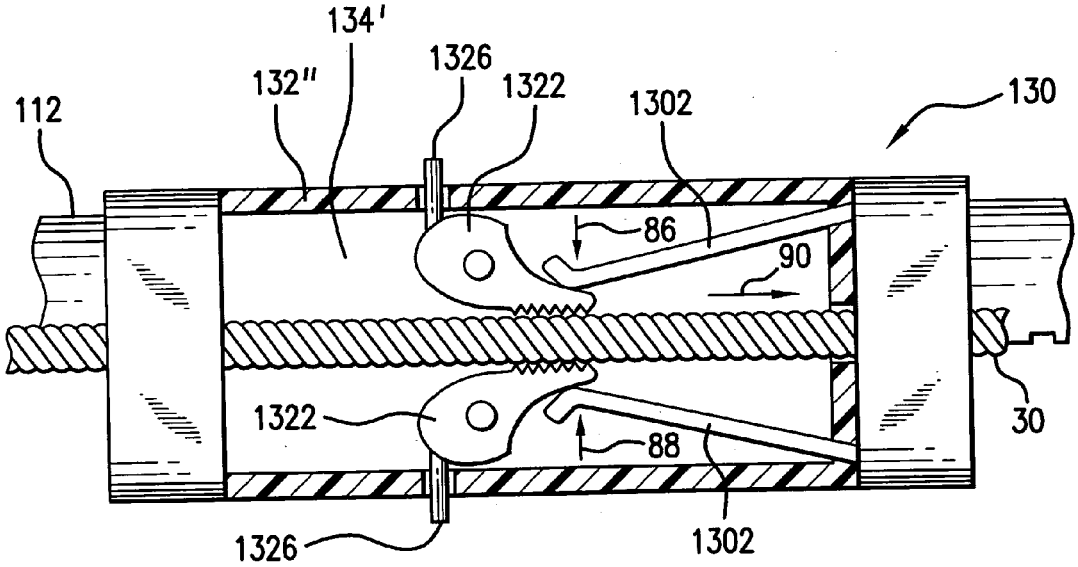
Figure 13:
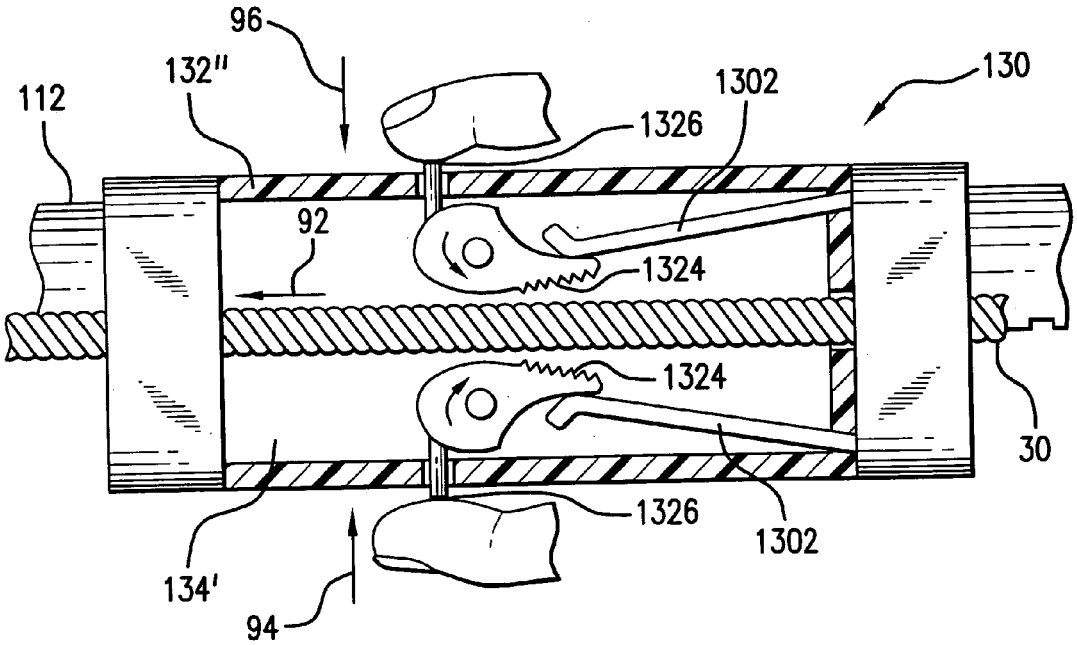

Turning now to FIGS. 12 and 13, there is shown further alternate configuration of the clamp assembly 130. In this arrangement, the clamp body 132" is provided with a pair of engaging members 1322, both engaging members 1322 extending into the substantially linear passage 134' to respectively engage the mooring line 30 passing therethrough. Each of the engaging members 1322 is respectively biased by a corresponding elastic member 1302, each being biased in a direction indicated by the respective directional arrows 86 and 88. As previously described, each engaging member 1322 has a camming surface 1324 allowing the mooring line 30 to be freely displaced in the direction indicated by directional arrow 90 but clampingly engaged when displacement is attempted in the opposing direction, indicated by directional arrow 92. When it is desired to displace the mooring line 30 in the direction indicated by directional arrow 92, a user simply displaces each of the corresponding displaceable portions 1326 in the directions indicated by the corresponding directional arrows 96 and 94, in order to rotate the engaging members 1322 and thereby displace the camming surfaces 1324 out of engagement with the mooring line 30.

Each of the elements which form the mooring apparatus 100 may be formed from any suitable material. In particular, one working embodiment of mooring apparatus 100 has been formed of all plastic parts, making it impervious to corrosion. Corrosion resistance is an important characteristic for the materials utilized in mooring apparatus 100, and some materials other than plastic may be successfully utilized. While the elastic members 1142 and 1302 have been depicted as leaf-type spring members other configurations, such as coil or hairpin type spring elements may be substituted, including the use of closed or open cell foamed plastic materials. Further, flexible member 120 may be a band or cord, formed of such materials as leather, reinforced or un-reinforced rubber or plastic compositions; rope of synthetic or natural fibers; or, cable formed of a metallic composition that may be coated with a plastic protective layer or sheath.

Although this invention has been described in connection with specific forms and embodiments thereof, it will be appreciated that various modifications other than those discussed above may be resorted to without departing from the spirit or scope of the invention. For example, functionally equivalent elements may be substituted for those specifically shown and described, certain features may be used independently of other features, and in certain cases, particular locations of elements may be reversed or interposed, all without departing from the spirit or scope of the invention as defined in the appended claims.

What is being claimed is:

1. An apparatus for mooring a boat, comprising:

a longitudinally extended handle member having an opening adjacent a distal end thereof;

a slider longitudinally displaceably mounted on said handle member, said slider being freely displaceable toward a proximal end of said handle member and releasably engaged with said handle member against displacement toward said distal end;

a flexible member having opposing ends disposed in overlapping relationship to form a loop, said overlapped opposing ends being passed through said opening and being coupled to said slider for displacement therewith, said loop being reduced in size in correspondence with said slider being displaced toward said proximal end;

a mooring line extending from the boat; and a clamp coupled to said slider, said clamp having at least one first engaging member for releasably engaging said mooring line.

2. The apparatus as recited in claim 1, wherein said handle member has a bore extending longitudinally from said opening and a longitudinally extended slotted opening formed through a wall of said handle member, said slotted opening being in open communication with said bore.

3. The apparatus as recited in claim 2, wherein said slider includes a slider body at least partially encompassing a circumferential portion of said handle member, and an anchor disposed in said bore and coupled to said opposing ends of said flexible member and said slider body.

4. The apparatus as recited in claim 3, wherein said slider includes at least one second engaging member pivotally coupled to said slider body for releasable engagement of said handle member responsive to displacement of said slider in said direction toward said distal end.

5. The apparatus as recited in claim 4, wherein said handle member includes a plurality of teeth formed in at least one surface thereof for said releasable engagement by said second engaging member.

6. The apparatus as recited in claim 5, wherein said slider includes a pair of second engaging members each pivotally coupled to said slider body in spaced relationship for respective releasable engagement with said plurality of teeth formed on corresponding surfaces of said handle member.

7. The apparatus as recited in claim 1, wherein said clamp has a passage formed therethrough for receiving the mooring line therein, said at least one first engaging member being biased to extend into said passage for contacting the mooring line.

8. The apparatus as recited in claim 7, wherein said passage has a U-shaped contour with respective entrance and exit openings disposed on one side of said clamp.

9. The apparatus as recited in claim 8, wherein said clamp includes a roller rotatably disposed in said U-shaped passage, the mooring line passing over said roller for reducing resistance to displacement thereof within said U-shaped passage.

10. The apparatus as recited in claim 1, wherein said clamp has a passage formed therethrough for receiving the mooring line therein and a pair of said first engaging member disposed on opposing sides of said passage, each of said engaging members being biased to extend into said passage for contacting the mooring line.

11. The apparatus as recited in claim 5, wherein said second engaging member has a camming surface formed on a distal portion thereof for passing over said teeth responsive to said slider being displaced toward said proximal end of said handle member, and engaging a respective tooth against said displacement of said slider toward said distal end of said handle member.

12. The apparatus as recited in claim 11, wherein said second engaging member has a manually displaceable portion spaced from said pivotal coupling of said second engaging member, said camming surface being displaced out of engagement with said respective tooth responsive to displacement of said manually displaceable portion by a user.

13. An apparatus for mooring a boat, comprising:

a handle assembly having a first member and a displaceable second member coupled to said first member, said second member being freely displaceable toward a first end of said first member and releasably engaged with said first member against displacement toward an opposing second end of said first member, a flexible member having opposing ends disposed in overlapping relationship to form a loop, said overlapped opposing ends being coupled to said second member for displacement therewith, said loop being changed in size responsive to said second member being displaced relative to said first member;

a mooring line extending from the boat; and, a clamp coupled to said handle assembly, said clamp having at least one first engaging member for releasably engaging said mooring line.

14. The apparatus as recited in claim 13, wherein said clamp is coupled to said second member for displacement therewith.

15. The apparatus as recited in claim 13, wherein said clamp has a passage formed therethrough for receiving the mooring line therein, said at least one first engaging member being biased to extend into said passage for contacting the mooring line.

16. The apparatus as recited in claim 15, wherein said passage has a U-shaped contour with respective entrance and exit openings disposed on one side of said clamp.

17. The apparatus as recited in claim 16, wherein said clamp includes a roller rotatably disposed in said U-shaped passage, the mooring line passing over said roller for reducing resistance to displacement thereof within said U-passage.

18. The apparatus as recited in claim 13, wherein said first member includes a plurality of teeth formed in at least one surface thereof and said second member includes at least one second engaging member pivotally coupled to said second member for respective releasable engagement with said teeth of said first member.

19. The apparatus as recited in claim 18, wherein said second engaging member has a camming surface formed on a distal portion thereof for passing over said teeth responsive to said second member being displaced toward said first end of said first member, and engaging a respective tooth against said displacement of said second member toward said second end of said first member.

20. The apparatus as recited in claim 19, wherein said second engaging member has a manually displaceable portion spaced from said pivotal coupling of said second engaging member, said camming surface being displaced out of engagement with said respective tooth responsive to displacement of said manually displaceable portion by a user.

21. An apparatus for mooring a boat, comprising:

a longitudinally extended handle;

a flexible member having opposing ends coupled to said handle to form a loop extending from a first end of said handle for engaging at least a portion of a structure;

a mooring line extending from the boat; and, a clamp coupled to said handle, said clamp having a passage formed therethrough for receiving said mooring line therein, said clamp having at least one mooring line engaging member that releasably engages said mooring line within said passage.

22. The apparatus as recited in claim 21, wherein said passage has a U-shaped contour with respective entrance and exit openings disposed on one side of said clamp.

23. The apparatus as recited in claim 22, wherein said clamp includes a roller rotatably disposed in said U-shaped passage, the mooring line passing over said roller for reducing resistance to displacement thereof within said U-passage.

24. The apparatus as recited in claim 21, further comprising a displaceable member mounted on said handle and having said opposing ends of said flexible member coupled thereto, said handle including a plurality of teeth formed in at least one surface thereof and said displaceable member includes at least one handle engaging member pivotally coupled to said displaceable member for respective releasable engagement with said teeth of said handle.

25. The apparatus as recited in claim 24, wherein said handle engaging member has a camming surface formed on a distal portion thereof for passing over said teeth responsive to said displaceable member being displaced toward a second end of said handle, and engaging a respective tooth against said displacement of said displaceable member toward said first end of said handle.

26. The apparatus as recited in claim 25, wherein said handle engaging member has a manually displaceable portion spaced from said pivotal coupling of said handle engaging member, said camming surface being displaced out of engagement with said respective tooth responsive to displacement of said manually displaceable portion by a user.

27. The apparatus as recited in claim 21, wherein said opposing ends of said flexible member are coupled to a displaceable member displaceably mounted to said handle.

28. The apparatus as recited in claim 27, wherein said clamp is coupled to said displaceable member for displacement therewith.

* * * * *